350-357

XR 4,060,975

United States TX350-357 ✓

4,060,975

Dec. 6, 1977

Yamaguchi

[54] METHOD AND APPARATUS FOR DRIVING ELECTROCHROMIC DISPLAY DEVICE

[75] Inventor: Sizuo Yamaguchi, Sayama, Japan

[73] Assignee: Citizen Watch Company Limited, Tokyo, Japan

[21] Appl. No.: 704,795

[22] Filed: July 13, 1976

[30] Foreign Application Priority Data

July 14, 1975 Japan ..... 50-85986

[51] Int. Cl.[2] ..... G04B 19/34

[52] U.S. Cl. ..... 58/50 R; 58/85.5; 58/23 R; 340/336; 350/160 R

[58] Field of Search ..... 58/4 A, 23 R, 23 A, 58/50 R, 85.5; 340/324 M, 336; 350/160 R, 160 LC

[56] References Cited

U.S. PATENT DOCUMENTS

| | | | |
|---|---|---|---|
| 3,839,857 | 10/1974 | Berets et al. | 340/336 X |
| 3,950,936 | 4/1976 | Oguey et al. | 58/23 R |
| 3,968,639 | 7/1976 | Berets et al. | 58/23 R |
| 3,987,433 | 10/1976 | Kennedy | 58/50 R X |
| 4,006,585 | 2/1977 | Tamaru et al. | 58/50 R |

*Primary Examiner*—Ulysses Weldon
*Attorney, Agent, or Firm*—Holman & Stern

[57] ABSTRACT

An electronic timepiece in which a high frequency signal from a frequency standard is divided down to a low frequency signal by a frequency converter. A decade decimal counter is connected between the frequency converter and a time counter to generate first, second and third phase signals in response to the low frequency signal from the frequency converter. The time counter is responsive to the first phase signal to gradually increment the count value therein, and is arranged such that it generates a reference time information signal prior to current time. First and second memory circuits are arranged to receive an output from a decoder in which the reference time information signal is converted into code format. The first and second memory circuits are responsive to the second and third phase signals from the decade decimal counter and to the coded signals from the decoder to generate bleaching signals and coloration signals, respectively, prior to current time.

10 Claims, 10 Drawing Figures

METHOD AND APPARATUS FOR DRIVING ELECTROCHROMIC DISPLAY DEVICE

This invention relates to a driver circuit for an electrochromic display device, and more particularly to a driver circuit for an electronic timepiece of the type using an electrochromic display device.

Electrochromic display devices have been recently used in various applications, including electronic timpieces. These differ in certain important respects from the liquid crystal display devices which have also been used in such applications. With a liquid crystal device, it is necessary to apply a continous potential or a high frequency pulse train to each display element which is to be actuated. With an electrochromic display device, however, application of single voltage pulse, causing a momentary flow of current through the electrochromic element, produces coloration of the element which persists for a period of minutes or days. Erasure of the coloration, referredd to herein as bleaching, is normally performed by the application of a voltage pulse of opposite polarity to that which caused coloration. The coloration effect is produced by reduction, and the bleaching by oxidation, of the electrochromic material.

In the case of a liquid crystal display, application of a potential to cause a change in the light reflectance or transmission properties of a display element results in a very rapid change in these properties. With the electrochromic displays which have been used up to the present, however, there is a relatively appreciable delay (i.e. of the order of tenths of a second) between the application of an activating voltage pulse and the occurrence of the required coloration or bleaching effect. In addition, there is a difference between the delay times for the coloration and bleaching effects. Such delays are obviously a disadvantage where an electrochromic display is required to be used with a high-precision electronic timepiece, since they will result in an error between the generation of current time indicating signals by the circuits of the timepiece and the corresponding visible display.

In addition, the difference between the response times for coloration and bleaching, respectively, will result in some segments of a display (for example a seven-segment digit) being colored to represent new data while, momentarily, some other segments used to represent previous data have not yet been bleached. This will cause an undesirable flickering effect each time the displayed data is changed, reducing the utility of the display.

It is, therefore, an object of the present invention to provide an improved driver circuit for an electrochromic display device.

It is another object of the present invention to provide circuit means whereby the driver circuit is actuated in such a way that display timing errors caused by a delayed response of the electrochromic display device are eliminated.

It is another object of the present invention to provide circuit means whereby undesirable effects caused by a difference between the response delays of the eletrochromic display device for coloration and bleaching, respectively, are eliminated.

It is a further object of the present invention to provide an improved method of driving an electrochromic display device.

These and further objects, features and advantages of the present invention will become more apparent from the following description when taken in conjunction with the accompanying drawings, in which.

Figure 1:
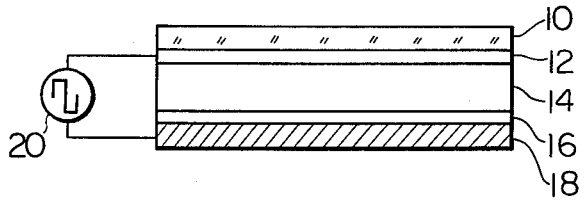
FIG. 1 is a cross section of an electrochromic display element.

Referring now to FIG. 1, there is shown an example of an electrochromic display element, in cross section. The electrochromic display element comprises a glass substrate 10, and a transparent electrode 12 which may comprise gold film evaporated onto the glass substrate 10. Contacting the transparent electrode 12 is an electrochromic (EC) layer 14, most suitably a layer of $WO_3$ vacuum deposited on the transparent electrode 12. Contacting the EC layer 14 is an insulating layer 16, of which thickness is selected to be as small as possible, to maintain the smallest separation between the counter-electrode 18 and the EC layer 14.

To actuate devices of this type, a power source 20 is coupled to the electrodes 12 and 18, with the coloring mode attained by making the EC layer negative. To bleach the colored state, the voltage is reversed.

Figure 2:
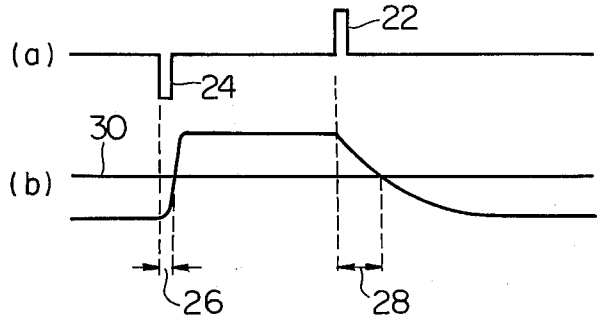
FIG. 2 is a waveform diagram showing the relationship between the response delays for coloration and bleaching and the opposite polarity current pulse applied to cause coloration and bleaching.

FIG. 2 shows the response characteristics of the electrochromic element to voltage pulses applied by the power source 20 shown in FIG. 1. The waveform (a) shows the actuating pulses to be applied to the EC display element while the curve (b) shows the visible response of the element to these pulses. Numeral 22 indicates the actuating pulse to induce bleaching of the EC devices and numeral 24 indicates the actuating pulse to induce coloration of the EC devices. Numeral 26 indicates the reponse time for coloration to occur in response to negative-going pulse 24, while 28 shows the response time for bleaching to occur in reponse to positive-going pulse 22. The borderline level between bleaching and coloration, at which color is only just visible to the human eye, is indicated by numeral 30.

As can be seen in FIG. 2, the response time for coloration to occur is substantially shorter than that for bleaching. This factor can cause an undesirable flickering effect when the contents of a data display constructed of elements shown in FIG. 1 are changed.

Figure 3:
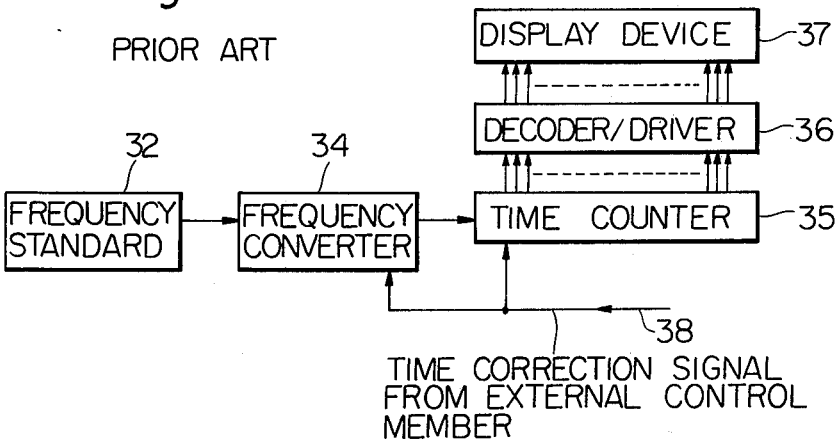
Fig. 3 PRIOR ART
FIG. 3 is a block diagram for a typical electronic timepiece using a light-emitting diode.

FIG. 3 shows an example of the essential features of a conventional electronic timepiece using a light-emitting diode or liquid crystal display. Frequency standard 32, which normally comprises a quartz crystal-controlled oscillator, provides a high-frequency output signal to a frequency converter 34. In frequency converter 34, the high frequency signal is frequency-divided to produce a standard output signal of one pulse per second. This output is applied to a time counter 35, wherein the seconds signals is counted to produce minutes data, the minutes are counted to provide hours data and the hours may be counted to provide date data. The data outputs from the time counter 35 are applied to a decoder-driver circuit 35, whereby they will normally be converted into 7-segment code format to drive the corresponding display digits of the LED display 37.

Shown at 38 is a time correction signal, applied from an external reset control member. This can be used by the timepiece wearer to set certain time data for example the seconds data in accordance with some standard reference time signal from a radio, etc. In the case of a light-emitting diode or liquid crystal display, the arrangement shown in FIG. 3 is satisfactory, since the display data will be very rapidly displayed when time correction signal 38 is applied. In the case of an electrochromic display, however, there will be a delay before the displayed data shows the corrected state, due to the response characteristics referred to above and shown in FIG. 2. Thus, following time correction, the timepiece would thereafter be displaying a time delayed by a certain amount with respect to the correct current time.

Figure 4:
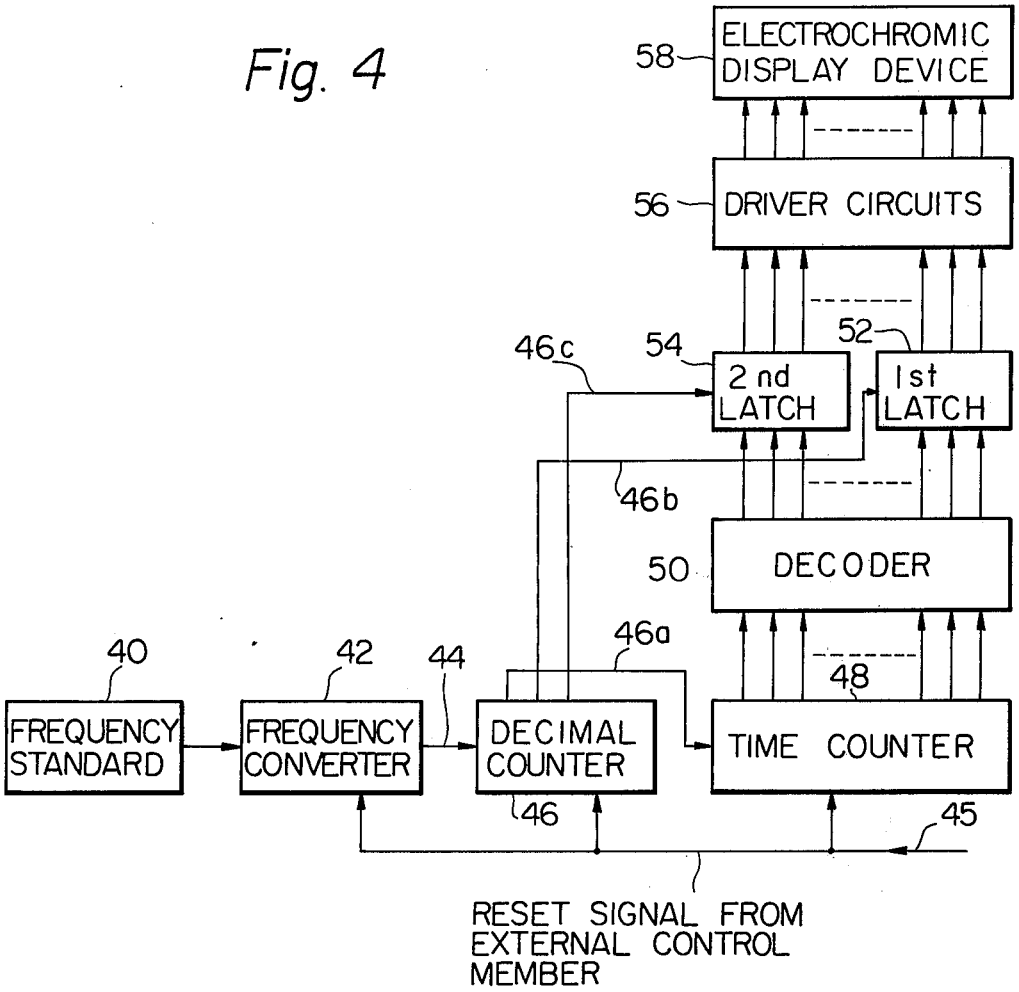
FIG. 4 is a block diagram for an electronic timepiece using an electrochromic display driven in accordance with the present invention.
Figure 5:
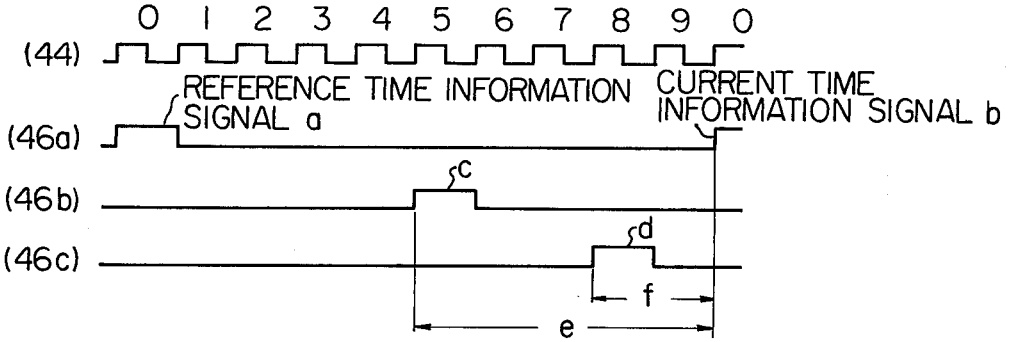
FIG. 5 is a waveform diagram showing the relationship between pulses indicating current time and the pulses which drive the electrochromic display elements with the present invention.

To obviate this disadvantage, the present invention proposes a circuit arrangement shown in block diagram form in FIG. 4. Here, as in FIG. 3, a frequency standard 40 and a frequency converter 42 are connected in series to produce a standard timing signal 44. This may have a frequency of 10 Hz, for example. The standard timing signal 44 is applied to a decade decimal counter 46, which serves as a signal generation means to produce first phase signal 46*a*, second phase signal 46*b* and third phase signal 46*c* outputs as shown in the waveform diagram of FIG. 5. Output 46*a* of counter 46 is a current time clock input to the time counter 48, which functions as described for the time counter 35 in FIG. 3, above. Two consecutive pulses of this output 46*a* are indicated as *a* and *b* in FIG. 5. Each time that one of the pulses 46*a* is generated, a new timing cycle is initiated in the first counter stage of time counter 48. Thus, since pulse *c* of output 46*b* and pulse *d* of output 46*c* are generated by the decade decimal counter 46 with the timing relationships to pulse *a* as shown in FIG. 5, it is clear that pulses *c* and *d* are advanced in phase by the amounts *e* and *f*, respectively, relative to the beginning of the particular timing cycle in time counter 48 which is initiated by pulse *b* of output 46*a*. Pulses 46*b* are used to cause bleaching and pulses 46*c* to cause coloration, respectively, of the electrochromic display. In addition, it is a feature of the present invention that when the time counter 48 is reset at the time of occurrence of some external reference timing signal, counter 48 is not reset to a count of zero, as for the counter described in FIG. 3 above. It is instead reset to an initial value of one or two, such that the counter contents are preset to correspond to a time value that is in advance of current time by one or two seconds.

Thus, for example, if counter reset is performed at the timing of pulse *a* of output 46*a* in FIG. 5, then the "seconds" data contents of time counter 48 will be set to a value of one, say, while counters 42 and 46 are reset to zero. However, since the new contents of the time counter 48 will not appear on the display until the occurrence of pulses *c* and *d* for bleaching and coloration respectively, then because of the response delays of the electrochromic elements described with reference to FIG. 2 above, the new "seconds" data value of "one" will not appear on the display until time *b* of pulses 46*a*, i.e. after one complete cycle of pulses 46*a*. Since at this time, the current time has increased by one second relative to the timing of pulse *a*, the timepiece is now displaying correct time data.

Figure 6:
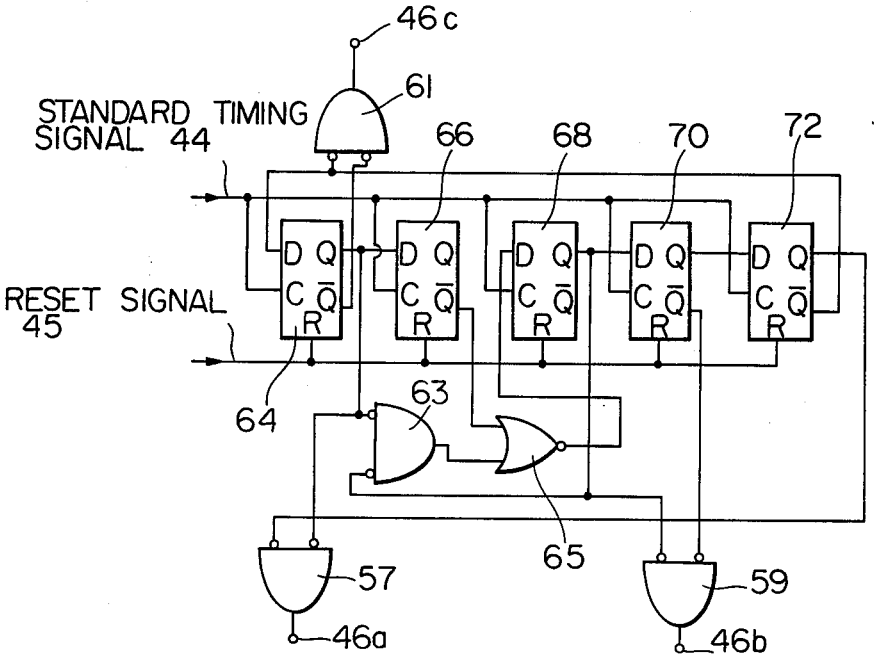
FIG. 6 is a circuit diagram of an example of a decade decimal counter to provide timing pulses for display driving according to the present invention.
Figure 7:
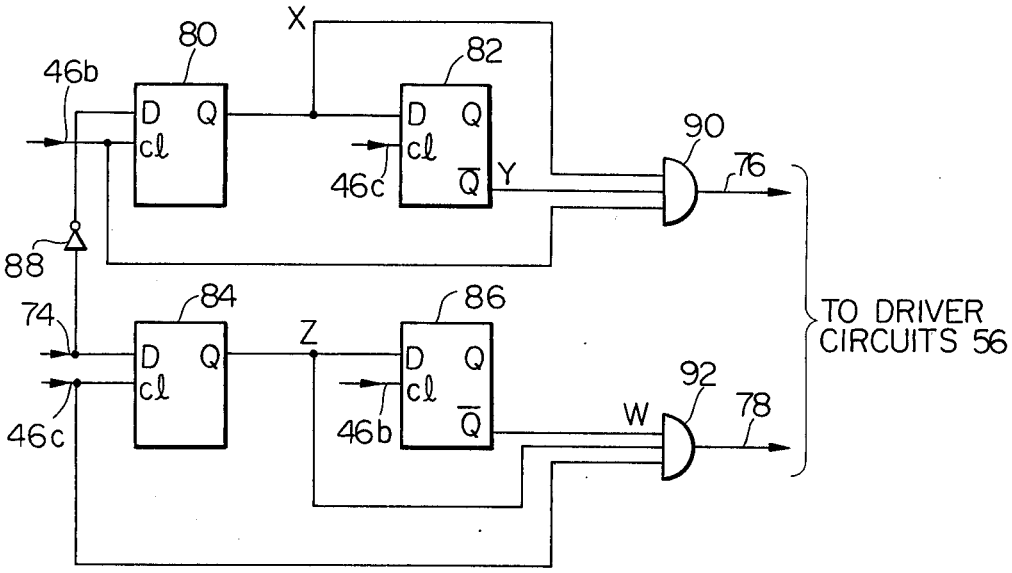
FIG. 7 is a detail circuitry for memory circuits which produce drive signals for application to the driver circuit.

A circuit example of a suitable decimal decade counter to provide the waveforms shown in FIG. 5 is given in FIG. 6. In this example a Johnson counter configuration is used, comprising data-type flip-flops 64 to 72 and gates 63 and 65. Gates 57, 61 and 59 produce outputs 46*a*, 46*b* and 46*c*, respectively, each of which remains high for one cycle of input clock signal 44. Outputs 46*a*, 46*c* and 46*b* are generated at counts "0", "5" and "8" of clock signal 44, for the timing shown in FIG. 5. Reset is performed by signal 45 applied to each reset terminal of the data-type flip-flops. In FIG. 4, the time data from time counter 48 is converted into suitable form for display segment driving, i.e. into 7-segment digit code for example. The output data from the decoder 50 remains at a steady-state level so long as the corresponding data in time counter 48 does not change. To convert these steady-state levels into suitable positive and negative-going drive pulses for the electrochromic display, memory circuits 52 and 54 are used in conjunction with driver circuits 56. Two memory circuits are used for each display segment, a first memory, which generates a pulse when segment coloration is required. The mode of operation of these memory circuits will now be explained with reference to FIG. 7 and FIG. 8.

Figure 8:
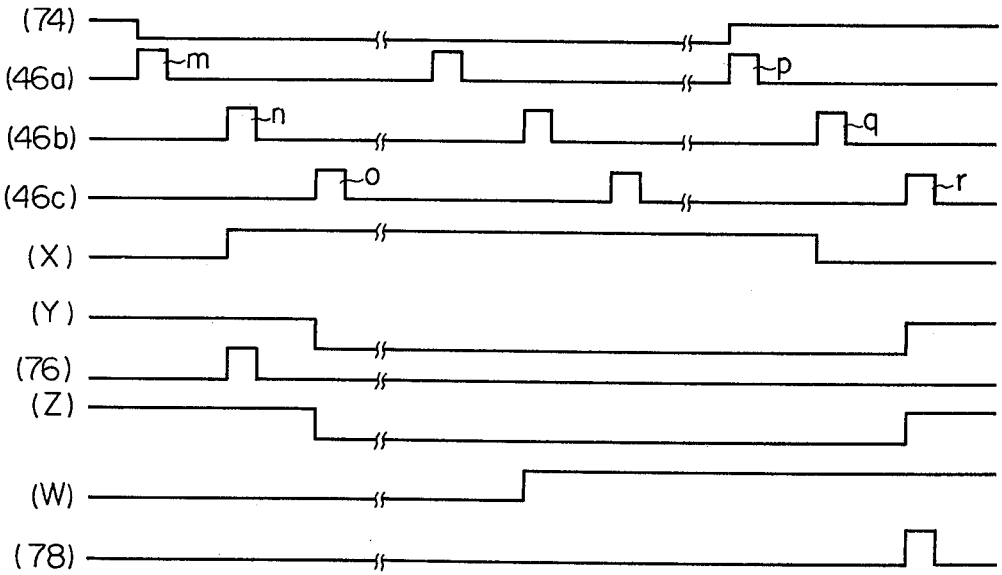
FIG. 8 is a waveform diagram for the circuit of FIG. 7.

In the waveform example of FIG. 8, output signal 74 from decoder 50 of FIG. 4 is changed in response to pulse *m* of clock pulses 46*a*, as a result of a change in count state of time counter 48 in FIG. 4. The high-to-low transition of signal 74 causes a low-to-high transition to occur at the output of inverter 88, which is connected to the data terminal of data-type flip-flop 80. Pulse *n* of pulses 46*b*, applied to the clock terminal of flip-flop 80 therefore causes output X of flip-flop 80 to go to the high logic level. Signal X is applied to the data input of flip-flop 82, and therefore when pulse *o* of pulses 46*c* occurs, the output signal Y from the $\overline{Q}$ terminal of flip-flop 82 goes to the low logic level Signals X, Y and 46*b* are applied to the inputs of AND gate 90, and thus an output pulse 76 is generated in response to pulse *n* of pulses 46*b* while output Y of flip-flop 80 is in high state. When output Y is set to the low logic level by pulse O of pulses 46*c*, further generation of pulses 76 is inhibited. Pulse 76 is applied to a driver circuit so as to cause bleaching of the corresponding display element, in a manner to be described hereinafter.

At some subsequent time, a low-to-high transition of signal 74 occurs as a result of pulse *p* of pulses 46*a*, which causes a change in the count state of time counter 48 in FIG. 4. Signal 74 is also applied to the data terminal of data-type flip-flop 84. Thus, pulse *r* of pulses 46*c* causes the output *Z* of flip-flop 84 to go to the high logic level. Output Z is applied to the data input terminal of flip-flop 86, but the output *w* of the $\overline{Q}$ terminal of flip-flop 86 will remain at its high logic level until subsequent pulse 46*b* occurs. Signals W, Z and 46*c* are applied to AND gate 92, and thus pulse *r* of pulses 46*c* cause output pulse 78 to be generated from AND gate 92. Pulse 78 is applied to a driver circuit to cause coloration of the corresponding display segment.

The operation of the driver circuit which constitutes switching means for driving a single segment will be explained with reference to FIG. 9. The positive and negative potential terminals of power source are connected to terminals 106 and 108, respectively, of an array of metal oxide semiconductor field effect transistors, referred to herein as FETs. The drain terminals of FETs 96 and 98 are connected together and also to one electrode of an electrochromic display element 112. The drain terminals of FETs 100 and 102 are similarly connected to the counter electrode of segment 112. Coloration drive signal 78 (generated as described above) is applied to the gate terminal of N-channel FET 102 and also through an inverter 94 to the gate terminal of P-channel FET 96. Thus when signal 78 goes to the high logic level, FETs 96 and 102 are set into their respective conducting states. The potential applied to terminals 106 and 109 is thereby applied to the electrodes of the electrochromic element 112 in such a way as to cause a current flow through the element 112 which causes coloration of the segment to occur.

Similarly, bleaching drive signal 76 is applied to the gate terminal of N-channel FET 98, and also to the gate terminal of FET 100 through inverter 104. Thus, when signal 76 goes to the high logic level, FETs 100 and 98 set into their respective conducting states. The potential applied to terminals 106 and 110 is, in this case, applied to the electrodes of element 112 in such a way as to cause a current flow through the element 112 which produces bleaching of the element.

Figure 9:
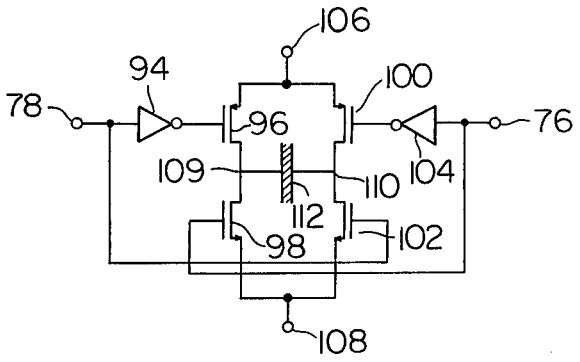
FIG. 9 is a detail circuitry for that part of the driver circuit connected to a single display element or segment.

Thus, the circuit of FIG. 9 effectively produces current pulses through the electrochromic element of the form shown in FIG. 2, to cause either coloration or bleaching.

Figure 10:
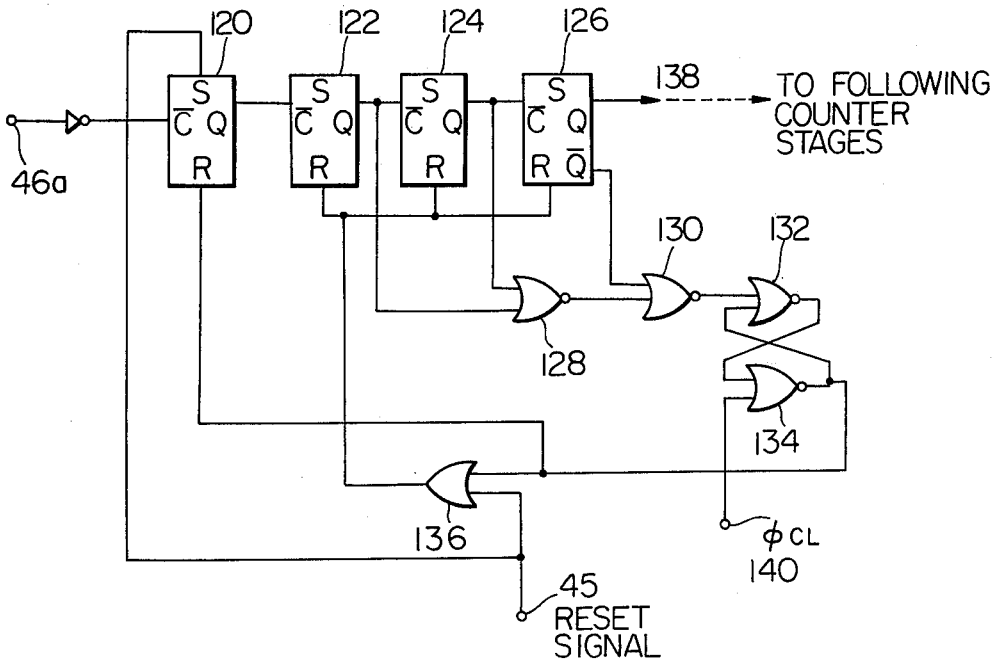
FIG. 10 is an example of a time counter circuit showing how reset is performed.

An example of a decade counter constituting the "units of seconds" section of time counter 48 is shown in FIG. 10. The decade counter is composed of a chain of flip-flops, with time standard signal 46*a* applied as an input clock signal. In the normal operating condition, the counter will count from zero to nine and will then be reset to the zero state by the nest clock pulse 46*a*, since a count of 10 is detected by gates 128 and 130, causing a pulse to be applied to trigger the latch circuit composed of gates 132 and 134. The output of the latch circuit, being connected to the reset terminal of flip-flop 120 directly, and connected to the reset terminals of flip-flops 122 to 126 through gate 136. The latch circuit is subsequently reset by the signal $0_{cl}$.

External reset signal 45 is also connected to the reset terminals of flip-flops 122 to 126, through gate 136. Signal 45 is, however, connected to the set terminal of flip-flop 120. Thus, when an external reset signal 45 is applied, the decade counter is preset to a count of one, thus generating a reference time information signal prior to the current time.

It will now be appreciated from the foregoing description that an electronic timepiece of the present invention is composed of a signal generation means to generate first, second and third phase signals and a time counter capable of being preset to generate a reference time information signal prior to the current time in response to the first phase signal. The electronic timepiece also comprises first and second memory circuits coupled to the decoder and responsive to the second and third phase signals and the reference time information signal to generate bleaching signals and coloration signals, respectively, prior to the current time such that the display of each digit will be made concurrently with the current time.

While the present invention has been shown and described with reference to particular embodiments, it should be noted that various other changes or modifications may be made without departing from the scope of the present invention. For example, although the memory circuits have been shown and described as arranged to generate a bleaching signal prior to a coloration signal, these circuits may be arranged to generate the coloration signal prior to the bleaching signal in a case where the electrochromic display device has a coloration speed slower than a bleaching speed. Also, while the memory circuits have been shown as constituted by data-type flip-flop by way of example, it should be noted that the memory circuits may comprise latch circuits, if desired.

What is claimed is:

1. In an electronic timepiece having a frequency standard for providing a higher frequency signal, a frequency converter to divide the higher frequency signal down to a lower frequency signal, a time counter coupled to the frequency converter to provide time information signals in response to the lower frequency signal, a decoder coupled to the time counter for generating decoded signals in dependence on the time information signals, and an electrochromic display device having display elements for displaying the decoded signals, the combination comprising:

signal generation means coupled between the frequency converter and the time counter to generate frst, second and third phase signals in response to the lower frequency signal;

means for presetting the count value in the time counter to cuase said time counter to provide a count value signal prior to a time represented by said count value signal;

a first latch circuit coupled to the decoder and responsive to said second phase signal and said decoded signals to generate a bleaching signal for bleaching the display elements at a first timing;

a second latch circuit coupled to the decoder and responsive to said third phase signal and said decoded signals to generate a coloration signal for coloring the display elements at a second timing.

2. The combination according to claim 1, in which said signal generation means comprises a decade decimal counter.

3. The combination according to claim 1, further comprising a driver circuit coupled to said first and second latch circuits for driving the display elements of the electrochromic display device in response to the bleaching signal and the coloration signal.

4. The combination according to claim 3, in which said driver circuit comprises first and second switching means coupled to said first and second latch circuits.

5. The combination according to claim 4, in which said first switching means comprises a first metal oxide semiconductor field-effect transistor having its gate terminal coupled through an inverter to said first latch circuit and its source terminal coupled to a positive potential, and a second metal oxide semi-conductor field-effect transistor having its gate terminal coupled to said second latch circuit and its source terminal coupled to a negative potential, said first and second metal oxide semiconductor field-effect transistors having drain terminals coupled together and connected to one side of each display element, and in which said second switching means comprises a first metal oxide semiconductor field-effect transistor having its gate terminal coupled through an inverter to said second latch circuit and its source terminal coupled to the positive potential, and a second metal oxide semiconductor field-effect transistor having its gate terminal coupled to said first latch circuit and its source terminal coupled to the negative potential, said first and second metal oxide semiconductor field-effect transistors of said second switching means having drain terminals coupled together and connected to another side of said each display element, said first metal oxide semiconductor field-effect transistor of said first switching means and said second metal oxide semiconductor field-effect transistor of said second switching means being conductive in response to said bleaching signal to cause an electric current to flow through said each display element in a bleaching direction while said first metal oxide semiconductor field-effect transistor of said second switching means and said second metal oxide semiconductor field-effect transistor of said first switching means being conductive in response to said coloration signal to cause the electric current to flow through said each display element in a coloring direction.

6. The combination according to claim 1, in which each of said first and second latch circuits comprises a first and second flip-flop, together with an AND gate, a normally high-level output terminal of said first flip-flop being connected to a data terminal of said second flip-flop and also to a first input terminal of said AND gate, and with a normally low-level output terminal of said second flip-flop connected to a second intput terminal of said AND gate, with said second phase signal being connected to a clock input terminal of said first flip-flop of said first latch circuit and with said third phase signal being connected to a clock input terminal of said second flip-flop of said first latch circuit.

7. The combination according to claim 6 in which said third phase signal and said second phase signal are applied to a clock terminal of said first flip-flop and of said second flip-flop of said second latch circuit, respectively.

8. The combination according to claim 6, further comprising an inverter, with an output of said inverter being connected to a data input of said first flip-flop of said first latch circuit and one of said decoded signals being applied to an input of said inverter and also applied to a data input of said first flip-flop of said second latch circuit.

9. The combination according to claim 6, in which said second and third phase signals are applied to an input of said AND gate of said first latch circuit and to an input of said AND gate of said second latch circuit, respectively.

10. A method of driving display elements of an electrochromic display device of an electronic timepiece having a frequency standard to provide a higher frequency signal, a frequency converter coupled to the frequency standard to divide the higher frequency signal down to a lower frequency signal, and a time counter responsive to the lower frequency signal to provide a time information signal, comprising the steps of:

generating first, second and third phase signals in response to the lower frequency signal from the frequency converter;

applying the first phase signal to the time counter to gradually increment the count value therein in response to the first phase signal;

presetting the time counter such that it generates a count value signal prior to a time represented by said count value signal;

generting a bleaching signal in response to said second phase signal and said count value signal for bleaching the display elements at a first timing; and generating a coloration signal in response to said third phase signal and said count value signal for coloring the display elements at a second timing.

* * * * *